US007514030B2

(12) United States Patent
Nilsson et al.

(10) Patent No.: US 7,514,030 B2
(45) Date of Patent: Apr. 7, 2009

(54) FABRIC CHARACTERISTICS BY FLAT CALENDERING

(75) Inventors: Anders Nilsson, Halmstad (SE); Goran Nilsson, Oskarström (SE); Ademar Lippi Fernande, Brummen (NL); David Rougvie, Appleton, WI (US); Lynn Kroll, Sherwood, WI (US); Jeffrey Scott Denton, Mendon, MA (US)

(73) Assignee: Albany International Corp., Albany, NY (US)

( * ) Notice: Subject to any disclaimer, the term of this patent is extended or adjusted under 35 U.S.C. 154(b) by 1044 days.

(21) Appl. No.: 10/334,165

(22) Filed: Dec. 30, 2002

(65) Prior Publication Data

US 2004/0154148 A1 Aug. 12, 2004

(51) Int. Cl.

| | |
|---|---|
| ***D06C 15/02*** | (2006.01) |
| ***D21F 1/10*** | (2006.01) |
| ***D21F 7/08*** | (2006.01) |
| ***D21F 7/12*** | (2006.01) |

(52) U.S. Cl. ..... 264/284; 162/348; 162/358.2; 162/900; 162/902; 162/903; 428/213; 428/218; 29/142

(58) Field of Classification Search ..... 162/116, 162/117, 306, 204–207, 348, 358.2, 900, 162/902–904, 361, 362; 28/110, 142; 442/270; 139/383 A, 425 A; 428/156, 170, 172, 213, 428/218; 264/280, 284; 198/846, 847
See application file for complete search history.

(56) References Cited

U.S. PATENT DOCUMENTS

| | | | | |
|---|---|---|---|---|
| 2,903,021 | A * | 9/1959 | Holden et al. | 139/425 A |
| 3,097,413 | A | 7/1963 | Draper, Jr. | |
| 3,109,219 | A | 11/1963 | Bell et al. | |
| 3,365,766 | A | 1/1968 | Tewksbury et al. | |
| 3,573,164 | A | 3/1971 | Friedberg et al. | 162/348 |
| 4,169,007 | A | 9/1979 | Pray | |
| 4,345,730 | A | 8/1982 | Leuvelink | |
| 4,438,788 | A | 3/1984 | Harwood | |
| 4,457,968 | A | 7/1984 | Harvey | |
| 4,500,588 | A * | 2/1985 | Lundstrom | 428/212 |
| 4,529,643 | A * | 7/1985 | Lundstrom | 442/275 |
| 4,541,895 | A | 9/1985 | Albert | |

(Continued)

FOREIGN PATENT DOCUMENTS

| | | |
|---|---|---|
| CS | 149546 | 9/1971 |

(Continued)

OTHER PUBLICATIONS

G.A. Smook, Handbook for Pulp and Paper Technologists, Tappi Press, pp. 272-275 (1992).*

*Primary Examiner*—Eric Hug
(74) *Attorney, Agent, or Firm*—Frommer Lawrence & Haug, LLP; Ronald R. Santucci

(57) ABSTRACT

A smoothed and durable industrial process fabric and method for producing such a fabric. The fabric may be used as a papermaker's fabric, other industrial process fabric and/or engineered fabric. In any case, the fabric is processed using a device comprising at least two smooth rolls which form a pressure nip, such as a calender, such that at least some of the fabric components are permanently deformed. Preferably, at least one of the rolls is heated to a pre-selected temperature.

74 Claims, 3 Drawing Sheets

U.S. PATENT DOCUMENTS

| | | | | | |
|---|---|---|---|---|---|
| 4,582,750 | A | | 4/1986 | Lou et al. | |
| 4,594,795 | A | | 6/1986 | Stephansen | |
| 4,823,688 | A | | 4/1989 | Wedel et al. | |
| 5,245,920 | A | | 9/1993 | Hess | |
| 5,251,551 | A | | 10/1993 | Abe et al. | 100/93 |
| 5,252,185 | A | * | 10/1993 | Ellis et al. | 162/206 |
| 5,318,670 | A | | 6/1994 | Link et al. | |
| 5,360,656 | A | | 11/1994 | Rexfelt et al. | |
| 5,407,737 | A | * | 4/1995 | Halterbeck et al. | 442/195 |
| 5,416,984 | A | | 5/1995 | Murray | |
| 5,440,821 | A | | 8/1995 | Hamrin | |
| 5,581,918 | A | | 12/1996 | Schilling et al. | |
| 5,597,450 | A | | 1/1997 | Baker et al. | |
| 5,783,501 | A | | 7/1998 | Schuetze et al. | |
| 5,837,102 | A | * | 11/1998 | Graf | 162/296 |
| 5,873,999 | A | | 2/1999 | Gaiser | |
| 6,036,819 | A | | 3/2000 | Miller et al. | |
| 6,202,553 | B1 | | 3/2001 | Schilling | |
| 6,258,445 | B1 | | 7/2001 | Schilling et al. | |
| 6,284,679 | B1 | | 9/2001 | Schilling et al. | |
| 6,306,260 | B1 | | 10/2001 | Kawashima | |
| 6,511,582 | B2 | * | 1/2003 | Westerkamp | 162/348 |
| 6,554,963 | B1 | * | 4/2003 | Botelho et al. | 162/289 |
| 6,592,636 | B1 | * | 7/2003 | Joyce | 442/1 |
| 6,726,809 | B2 | * | 4/2004 | Joyce et al. | 162/358.1 |

FOREIGN PATENT DOCUMENTS

| | | | | |
|---|---|---|---|---|
| CS | 156131 | | | 1/1972 |
| CS | 182159 | | | 8/1976 |
| CS | 189486 | | | 8/1977 |
| CS | 196089 | | | 12/1977 |
| CS | 217740 | | | 4/1981 |
| CS | 250529 | | | 9/1985 |
| CS | 262 925 | | | 3/1987 |
| EP | 0 544 167 | A1 | | 11/1992 |
| EP | 0 972 876 | | | 7/1999 |
| EP | 0 999 306 | | | 10/1999 |
| GB | 1 540 056 | | | 1/1975 |
| GB | 2 012 327 | | * | 7/1979 |
| GB | 2 012 327 | A | | 7/1979 |
| JP | 08-071336 | | | 3/1996 |
| RU | 1006557 | A | | 6/2002 |
| WO | WO 97/01431 | | * | 1/1997 |
| WO | WO 98/27277 | | | 6/1998 |

* cited by examiner

FABRIC CHARACTERISTICS BY FLAT CALENDERING

BACKGROUND OF THE INVENTION

1. Field of the Invention

The present invention is directed toward endless fabrics, and more particularly, fabrics used as industrial process fabrics in the production of, among other things, wetlaid products such as paper, paper board, and sanitary tissue and towel products; in the production of wetlaid and drylaid pulp; in processes related to papermaking such as those using sludge filters, and chemiwashers; in the production of tissue and towel products made by through-air drying processes; and in the production of nonwovens produced by hydroentangling (wet process), meltblowing, spunbonding, and airlaid needle punching. The term "industrial process fabrics" also includes but is not limited to all other paper machine fabrics (forming, pressing and dryer fabrics) for transporting the pulp slurry through all stages of the papermaking process.

2. Description of the Prior Art

During the papermaking process, a cellulosic fibrous web is formed by depositing a fibrous slurry, that is, an aqueous dispersion of cellulose fibers, onto a moving forming fabric in the forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which cause the cellulosic fibers in the web to adhere to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

The present invention primarily concerns the papermaking fabrics which run on the various sections of a paper machine, as well as to fabrics used in other industrial settings where fabric surface smoothness, fiber support, non-marking, planarity and controlled permeabilities to water and air are of importance. Examples of the papermaking fabrics to which the invention applies are forming fabrics which run in the forming section of a paper machine, press fabrics which run in the press section, and drying fabrics which run in the drying section. Another example of an industrial process fabric to which the invention can be applied is a through-air-drying (TAD) fabric. A TAD fabric can be used in a variety of industrial settings, including papermaking. Some fabrics can be processed to act as a transfer fabric and can either be permeable or impermeable.

Papermaking fabrics, especially forming and drying fabrics, are generally woven in flat form and joined into endless-loop form with a seam. During the weaving process, the warp yarns, generally plastic monofilaments, are interwoven with weft, or filling yarns, also generally polymeric plastic monofilaments, in a desired pattern. In a fabric woven in flat form, the warp yarns eventually lie in the machine, or running direction of the fabric, while the weft yarns lie in the cross-machine direction.

After weaving, the fabric is heatset. The heatsetting, in which the fabric is placed under tension in the warpwise direction in the presence of heat, transfers some of the warp crimp to the weft yarns, smoothing the surface of the fabric to a degree and stretching the fabric in the warpwise direction to reduce the amount it could possibly stretch during use on a paper machine. Seaming or joining techniques are then employed to process the fabric into an endless loop as known in the art. For endless woven or modified endless woven fabrics, the processes form a complete tube of approximately the required length and width. Modified endless weaving results in a seam to allow easy installation on the machine. The weft yarns are now the MD yarns, and the warp yarns are CD yarns. The fabric is also heatset for sizing and crimp transfer and batt fiber is subsequently applied to one or both surfaces by processes such as needling.

As part of the later or last manufacturing steps, the surface of the fabric may be further smoothed by grinding, or sanding, which reduces the difference in height between the knuckles formed by the warp yarns and those formed by the weft yarns. Unfortunately, the grinding is essentially a form of wear which occurs before the fabric is even shipped to a customer, and potentially reduces the useful life span of the fabric.

In the case of press fabrics, the fabric can be pre-compacted under heat and pressure to cause some densification of the fabric by reducing thickness. This does not cause permanent fiber deformation.

Finally, the heatset, possibly needled and possibly ground, endless fabric loop of desired length and width is shipped to a customer for installation on the forming, press or dryer section of a paper machine, or use on a nonwovens machine.

SUMMARY OF THE INVENTION

It is an object of the present invention to provide an industrial process fabric that has a smoother, more planar, permanently deformed surface yet remains durable and cost effective.

It is a further object of the present invention to provide an alternate approach for smoothing the surface of a fabric, which approach does not result in the removal, such as by grinding or sanding, of any material from the surface thereof prior to shipment to a customer.

In view of the drawbacks in prior industrial process fabrics, a smoother, more planar, and permanently deformed surface and durable industrial process fabric is provided. The fabric may be used as a papermaker's fabric, other industrial process fabric and/or engineered fabric. In any case, the fabric is processed using a device comprising at least two smooth rolls which form a pressure nip, such as a calender, such that at least some of the fabric components are permanently deformed. Preferably, at least one of the rolls is heated to a pre-selected temperature.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PREFERRED EMBODIMENTS

Figure 1:
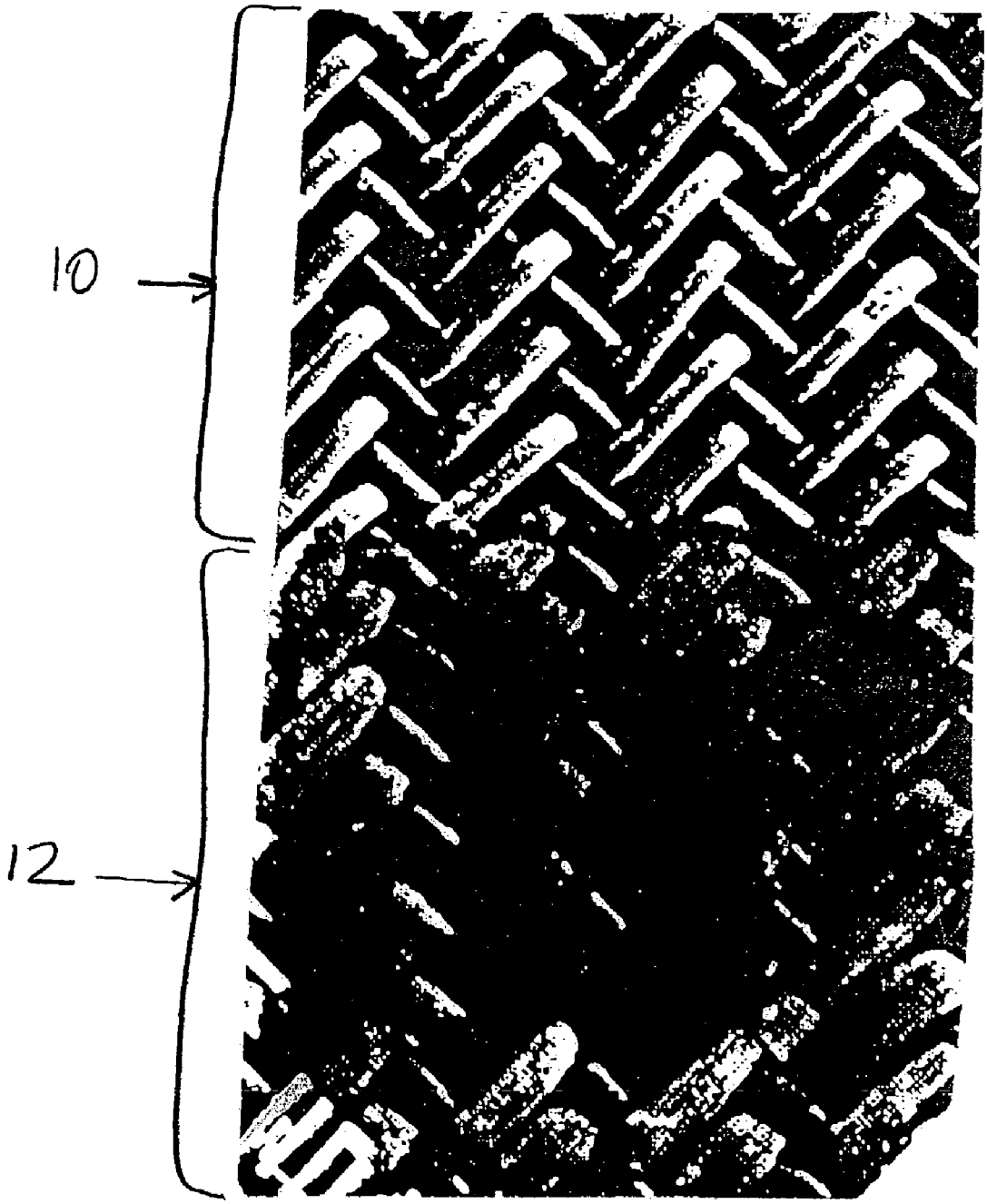
FIG. 1 shows how processing a fabric in accordance with the invention can modify the fabric.

A preferred embodiment of the present invention will be described in the context of a papermaking forming fabric. However, it should be noted that the invention is applicable to the fabrics used in other sections of a paper machine, as well as to those used in other industrial settings where surface smoothness and planarity, and controlled permeabilities to water and air are of importance. Some examples of other fabric types to which the invention is applicable include papermaker's press fabrics, papermaker's dryer fabrics, through-air-drying fabrics and pulp forming fabrics. Another example is of fabrics used in related-to-papermaking-processes such as sludge filters and chemiwashers. Yet another example of a fabric type to which the invention is applicable is engineered fabrics, such as fabrics used in making nonwoven textiles in the wetlaid, drylaid, meltblown and/or spunbonding processes.

Furthermore, the invention is generally described in the context of calendering a "fabric." However, it should be noted that the term substrate is appropriate for referring to the broad range of materials that may be calendered in accordance with the invention. Suitable substrates include woven fabrics, nonwoven fabrics, MD yarn arrays, CD yarn arrays, knits, braids, foils, films, spiral link and laminates. A substrate calendered in accordance with the invention may be used as, or as part of, an industrial process fabric such as a papermaker's forming fabric, a papermaker's pressing fabric, a papermaker's drying fabric, a through-air-drying (TAD) fabric, a double-nip-thickener (DNT) dewatering fabric, a chemiwasher belt and a fabric used in the production of nonwovens.

Typically, the papermaker's fabrics to which the present invention may be especially applied are primarily woven from monofilament yarns in both the warp and weft directions. As is well known to those of ordinary skill in the art, the warp yarns lie in the cross-machine direction (CD) of the fabric produced by either endless or modified endless weaving, while they lie in the machine direction (MD) if the fabric is flat woven. On the other hand, the weft yarns lie in the machine direction (MD) of a fabric produced by endless or modified endless weaving, but in the cross-machine direction (CD) of a flat-woven fabric.

The monofilament yarns may be extruded, or otherwise produced, from any of the polymeric resin materials commonly used by those of ordinary skill in the art for producing yarns for use in papermaker's fabrics, such as, for example, polyamide, polyester, polyetheretherketone, polypropylene, and polyolefin resins. Other yarn types such as plied monofilament, multifilament, plied multifilament, etc can be used, as commonly known in the art.

More often then not, the yarns used are round in cross-section. However, there are products wherein a shaped, rectangular yarn is used. However, there are some processing issues when using these types of non-round yarns, and there are many fabrics where there is concern for the geometry of the yarns at cross-overs or knuckles and a flat yarn along its entire length may be detrimental to a fabric's properties.

In the weaving of a papermaker's fabric, knuckles are formed on its surface where the yarns in one fabric direction pass over one or more yarns in the other fabric direction. The knuckles are elevated relative to other yarns forming the surface of the fabric, and can mark the paper sheet being manufactured on the fabric. This is true in all three sections of the paper machine.

Where grinding or sanding, are customarily used to smooth the surface or reduce the planarity of, for example, the forming fabric, in the present invention the fabric is calendered to produce a similar effect without removing any material from the knuckles by grinding. At the same time, the permeabilities of the fabric to air and water may be set to some desired level by compression in the calender nip. Preferably, the fabric is placed under tension as it is calendered.

The calender comprises at least two smooth rolls, at least one of which can be heated. The heated roll or rolls are at a temperature in a range from room temperature to 300° C., the exact temperature to be used being governed by the polymeric resin material making up the yarns of the fabric, applied compressive load, and desired fabric property.

The gap width between the calender rolls is in the range from 0.1 mm to 4.0 mm, the exact width being governed by the caliper of the fabric to be calendered, and by the degree by which its thickness is to be reduced. The pressure, or load, under which the fabric is compressed in the nip is in the range from 0 kN/m to 500 kN/m.

The fabric to be calendered is placed under tension, and passed through the nip at speed in a range from 0.5 m/min to 10 m/min, the speed to be used being governed by the time each increment of the length of the fabric is to remain in the nip.

Other settings that may be varied include fabric tension before the nip, fabric tension after the nip and preheating of the fabric prior to calendering. The preferred range for the tension before the nip and the tension after the nip is 0.1 to 30 kN/m.

The calender process settings, for example, roll temperature, gap width, compression load and speed through the nip, are determined according to the characteristics desired in the calendered fabric. Characteristics that may be modified through the inventive calendering include permeability, caliper, planarity, void volume, projected open area or surface contact area and smoothness. Experiments show that, for instance, air permeability can be reduced by as much as 50% or more.

The raw materials making up the fabric to be calendered also impact the characteristics of the finished fabric, and therefore should be considered when determining the process settings. Trial and error is one way to determine the settings needed to achieve particular characteristics.

The calender rolls may have surfaces of metal, polymeric resin material, rubber or a composite material such as ceramic or cermet alloy.

FIG. 1 shows how processing a fabric in accordance with the invention can modify the fabric. For purposes of illustrating how a processed fabric compares to the unprocessed fabric, a processed portion or fabric 12 is shown adjacent to an unprocessed portion or fabric 10. It can be seen from FIG. 1 that the warp and weft yarns of the calendered portions are flattened relative to the yarns of the unprocessed fabric.

Figure 2:
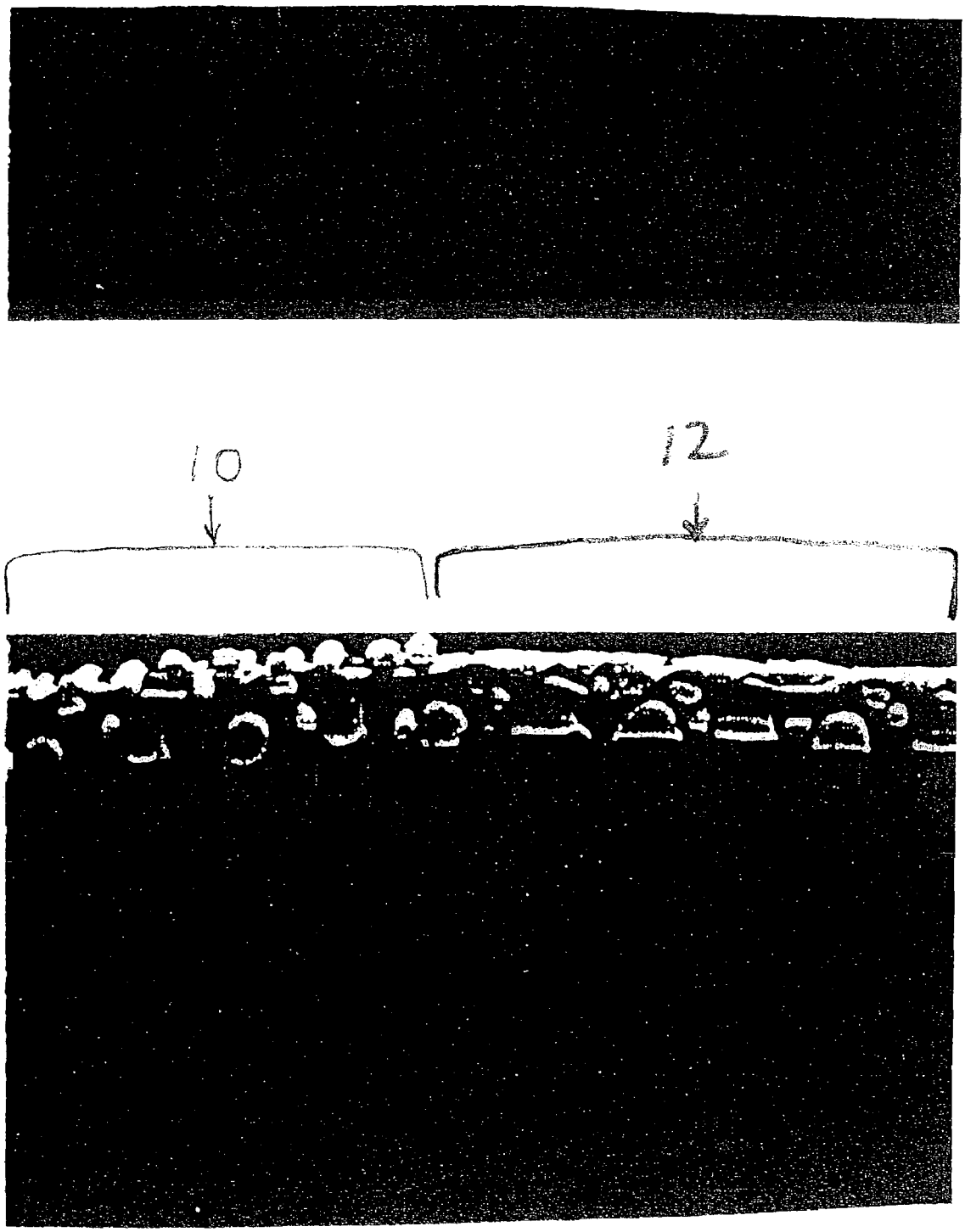
FIG. 2 shows a cross sectional view of the depiction in FIG. 1.

FIG. 2 shows a cross sectional view of the depiction in FIG. 1. As can be seen from FIG. 2, the flattened yarns of processed portion 12 give the processed portion a thinner cross section than the unprocessed portion 10.

Figure 3:
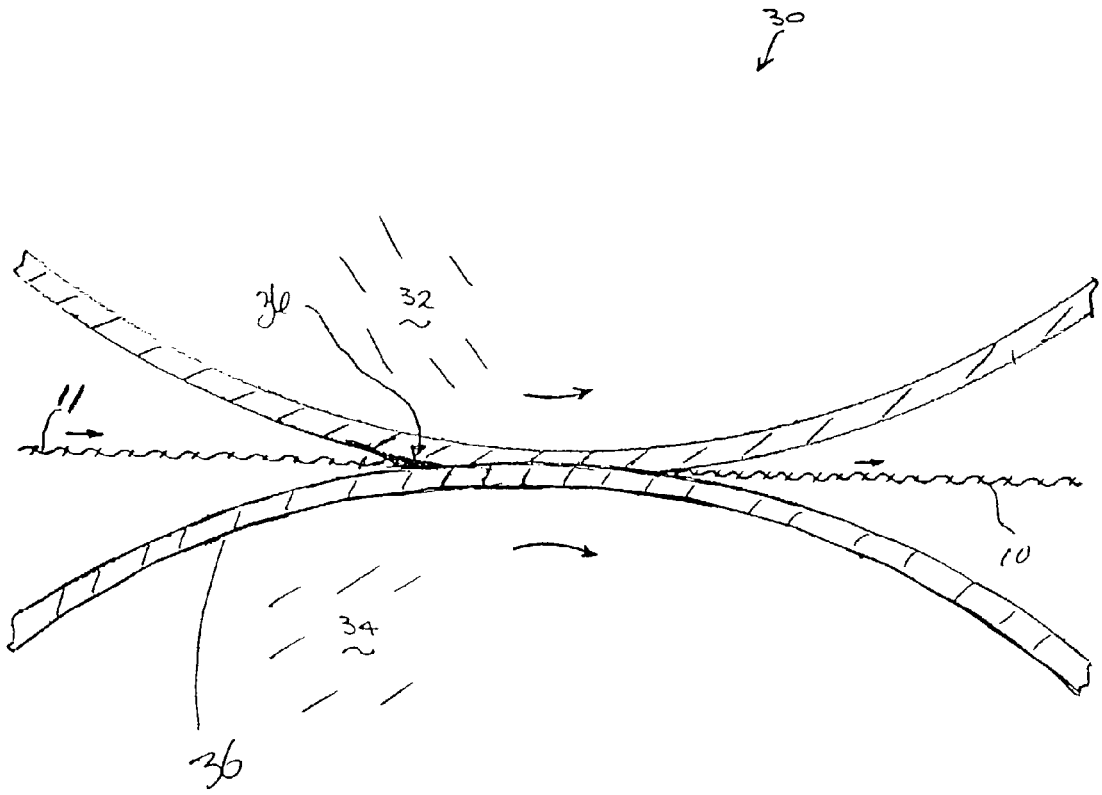
FIG. 3 shows a preferred embodiment of a calendering process in accordance with the present invention.

Turning now to FIG. 3, there is shown a preferred embodiment of the invention which allows the calendering process on the fabric to be carried out continuously by way of a two-roll calender 30. While using a calender is envisioned as a preferred method, using a platen press is one possible alternative. Further, a combination of a calender and a platen press may also be used.

Referring back to FIG. 3, a two-roll calender is formed by a first roll 32 and a second roll 34. The calender rolls are smooth. A fabric 11 is fed into the nip 36 formed between the first and second rolls, 32 and 34, which are rotating in the directions indicated by the arrows. One or both of the rolls are heated to a pre-selected temperature. The rotational speed of the rolls is governed by the dwell time needed for the fabric to be calendered in the nip, the nip temperature, and the force being provided by compressing the first and second rolls together.

The invention implements two alternative types of calendering: load-based calendering and gap-based calendering. In load-based calendering, the load exerted on the fabric by the calender rolls is maintained at a constant, or substantially constant, level while the gap between the rolls is allowed to vary. By contrast, in gap-based calendering, the gap between the rolls is maintained at a constant, or substantially constant, distance while the load is allowed to vary. One can switch between the two techniques to achieve different results. For example, load-based calendering can be used when it is desired that a fabric being calendered is compressed to the point where the fabric's physical resistance matches the load of the rolls, making further compression impossible; whereas the same fabric may be run through a calender set to a particular gap width that compresses the fabric to a point short of the point where the physical resistance of the compressed fabric matches the load. In general, the load-based calendering to the physical limit results in a greater fabric deformation than the gap-based calendering short of the physical limit.

Among the benefits of the present invention is that the calendering can reduce the caliper of the papermaker's fabric and improve its runnability. The accompanying reduction in void volume lowers the amount of water that can be carried by the fabric, and reduces the amount by which rewet can occur. Accordingly, calendering in accordance with the invention can be used as a mechanism for rewet control.

Further, fabrics produced in accordance with the invention provide smoother, denser support structures, relieving the need for high mesh count weaves of small diameter yarns. Still further, the thinner structure of the fabrics is more stable and the crimped yarns/fibers of the fabric provide for stronger seams, and greater structural integrity as well as improved dimensional stability in both the MD and CD directions.

Moreover, with calendering, grinding or sanding will be avoided. Since the fabric will, in that case, not be worn before actual use, its stability, strength and longevity will be improved. The calendered surface marks the sheet less than a sanded surface because no microscopic roughness will remain on the planar knuckle surface. The smoothness of the calendered surface also allows for increased sheet fiber support. Sheet release will also be improved.

Fabrics produced according to the present invention can be used in many papermaking applications. For instance, the fabrics can be used as forming fabrics, press fabrics, dryer fabrics and through-air-drying fabrics. The fabrics of the invention can also be used as pulp forming fabrics, and as engineered fabrics such as fabrics used in making nonwoven textiles in the wetlaid, drylaid, meltblown and/or spunbonding processes. When a fabric according to the invention is used in a papermaker's fabric that includes a needled batt and the base fabric is calendered, the resulting fabric is thinner and more stable due to the reduced thickness and increased stability of the fabric. In addition, less batt is present in the base due to the thinner, denser base, thereby imparting better stratification. A relatively coarse batt can be used to compensate for the reduction in permeability caused by the calendering and thereby provide a fabric having a permeability matching the permeability of prior fabrics but with greater resistance to plugging and filling due to entrapped particles common to the papermaking process. As an alternative, the fabric can be calendered after batt is applied if desired, whether the base is calendered or not.

Further, the permanent deformation imparts improved startup characteristics to a papermaking press fabric. Conventional thought concerning startup is that the break-in period is necessary due to the fabric being too thick in the nip (causing a lower peak pressure driving force), to the fabric being too open (too high an air permeability) and/or to the surface of the fabric being too nonuniform (causing localized areas of low peak pressure). As time goes on (the startup period), the fabric becomes thinner, less open, more dense, and probably smoother, thereby improving it's dewatering characteristics. The fabric eventually reaches it is equilibrium thickness and dewatering effect, and is then said to be in its "steady state." The permanent deformation of the invention advances the compaction and smoothing of the fabric so that less compaction and smoothing must occur during the fabric's use and the startup period is shortened.

Also, by using the calendering of the invention to improve startup in the case of needled press fabrics, one can avoid the drawbacks of using finer (smaller denier) fibers on the fabric surface to improve startup. Finer fiber surfaces tend to fill up with foreign matter (papermaking components such as cellulose, resins, clay, etc) and are more difficult to clean. Additionally, finer fibers generally have lower abrasive wear resistance and so they tend to wear away faster than coarser fibers.

Another advantage of calendered fabrics of the invention is the reduction in dragged air. That is, the "flat" yarns/fibers of the calendered fabric drag less air along their direction of motion than would be dragged by the "round" yarns/fibers of prior fabrics. Reduction of sheet blowing or dropoff is a positive result.

Experiments have demonstrated the viability of the invention. In one experiment, 16 instances of calendering were performed on samples that were each 24" wide and 10' long. After the samples were calendered, caliper and permeability measurements were made in 5 positions along each sample's length and width. The measurements revealed only insignificant differences in caliper and permeability along the length and width of each fabric, demonstrating that the calendering process of the invention is uniform and repeatable.

In a another experiment a first sample of 75 m long fabric was processed to a 22% knuckle area and a second sample of 75 m long fabric was processed to a 0.15 mm caliper reduction compared to unprocessed fabrics. The knuckle area was measured by considering a unit area of the fabric, laying the fabric flat and finding the highest point on the surface of the fabric, calculating the amount of unit area wherein there is fabric material within a depth of 0 to 10 microns from the highest point, and then forming a ratio of the determined amount to the total unit area.

Calendering can be carried out on the full width fabric via a full width calender, or by a narrower calender unit that, for example, calenders the fabric in sequential MD or CD bands until the entire fabric is calendered. In the case of full width calendering, it is preferable to pass the fabric through the calender rolls along the direction of the MD yarns and to use at least one roll that has a width that is about equal to, or greater than, the entire width of the fabric as measured along the direction of the CD yarns. It is most preferable in full width calendering to use two rolls that have widths that are about equal to, or greater than, the entire width of the fabric as measured along the direction of the CD yarns. In the case of narrow unit calendering, the calender unit can traverse in a spiral manner across the width of the fabric until the entire fabric is processed. When a narrower unit is employed substantial cost savings are realized, due in part to the reduced size of the equipment needed to perform the calendering operation. Furthermore, in the case of narrow unit calendering, the traversing unit can comprise two rolls of a width narrower than the fabric to be calendered, e.g. 1.0 m, or one narrow roll traversing across a full width roll. Also in some fabrics, it may be desired to only calender MD bands in the fabric, for example just the edges of the fabric to reduce fabric permeability there to eliminate sheet edge flutter or edge blowing. MD bands can also be calendered in a sequential but different degree so there is a desired differential in for example permeability as you move from edge to center of the fabric and then from center to other edge. This gives a fabric a permeability profile across the width, desirable in many dryer fabrics to enhance the moisture profile (reduce the moisture differential) in the paper sheet to be dried.

The narrow unit calendering of the invention is particularly useful in the context of dryer fabrics. In one implementation, a narrow calendering unit is used to calender only the edge regions of a fabric to reduce permeability and sheet blowing. In a related implementation, narrow unit calendering is applied to selected bands along the fabric's length in order to vary the permeability across the width of the fabric and thereby impart a desired moisture profile to the fabric. In either case, the width of the calendering applied, the calendering load and/or calendering gap may be varied from band to band. For seamed fabrics, the calendering can be applied before or after seaming. In a preferred embodiment, calendering is employed as a means to achieve a permanent thermoplastic deformation of the dryer fabric. Experimental results have demonstrated that calendering dryer fabrics according to the invention can reduce the permeability of calendered portions by up to 60%. The results also show caliper reduction of up to 30% and an increase in contact area from less than 10% to greater than 45%, all factors that improve drying efficiency. It should be noted that while the narrow width calendering of dryer fabrics is emphasized, it is possible to apply the full width calendering of the invention to dryer fabrics.

In addition, calendering can be used in combination with the manufacturing technique of U.S. Pat. No. 5,360,656 to Rexfelt et al., hereby incorporated by reference. In one such embodiment, a fabric strip having a relatively narrow width is calendered and then assembled in a spiral fashion in order to produced a finished calendered fabric. An advantage of such an embodiment over calendering a relatively wide fabric in bands, is the avoidance of any potential calender overlap. That is, when calendering a relatively narrow strip with a calender wide enough to cover the strip in one pass, there is no need to calender the strip in sequential passes, thereby avoiding the possibility of overlapping calender passes, and the resulting double-calendered strips. Nevertheless, it should be mentioned that it is possible to first spirally assemble a fabric in accordance with U.S. Pat. No. 5,360,656 and then calender the assembled fabric. As is the case with a non-spirally formed fabric, calendering of a spirally formed fabric can be carried out in sequential MD or CD bands or in a spiral manner across the width of the fabric.

Two further embodiments of the present invention are calendering fabrics made up of linked helical coils as described in U.S. Pat. No. 4,345,730 to Leuvelink; and calendering fabrics made of spirally wound yarns as described in U.S. Pat. No. 3,097,413 to Draper, Jr. Both U.S. Pat. No. 4,345,730 and U.S. Pat. No. 3,097,413 to Draper, Jr. are hereby incorporated by reference.

In any event, the permanent deformation of the fabric structure is a key feature of the invention. The deformation can be applied to a substrate structure in varying degrees to form a respective number of final structures. For example, a dryer fabric with a fixed number of yarns and a characteristic permeability may be calendered to various degrees to realize dryer fabrics having a range of permeabilities. Thus, delivery of a fabric having a particular permeability can be achieved with great speed, resulting in quicker response to customer demands. Moreover, other, more costly methods of changing permeability, such as increasing the yarn density and using flat shaped yarns, need not be employed.

In sum, the characteristics of a fabric that may be positively modified by calendering include: stability in both MD and CD; permeability as defined by ability to allow passage of fluid; caliper; planarity; void volume; sheet support; non-marking; sheet release; resistance to contamination; removal of contamination; performance lifetime; aerodynamics; start-up period; and resistance to abrasive wear, or wear due to the use of high pressure cleaning showers.

Modifications to the present invention would be obvious to those of ordinary skill in the art in view of this disclosure, but would not bring the invention so modified beyond the scope of the appended claims. For example, calendering according to the invention may be applied to a laminate structure such that one or more layers of the laminate is permanently deformed while the other layer or layers are not permanently deformed. Moreover, the calendering of the invention is not limited in its application to an entire substrate/fabric, but rather, may be applied to selected areas of a substrate/fabric, such as to the knuckle areas of a substrate/fabric.

What is claimed is:

1. A method for processing an industrial process or an engineered fabric, comprising the step of passing a substrate through at least two calender rolls such that the substrate is permanently deformed, wherein said calender rolls apply a gap-based calendering to said substrate with said calender rolls being set to a pre-selected gap width.

2. A method as claimed in claim 1 wherein at least one of said calender rolls is heated to a pre-selected temperature.

3. A method as claimed in claim 2 wherein said pre-selected temperature is selected according to at least one material included in the substrate and a characteristic desired in the fabric.

4. A method as claimed in claim 3 wherein said at least one material is in a form selected from the group consisting of yarns, fibers, filaments, spiral coils, foils, films, and laminates.

5. A method as claimed in claim 2 wherein said pre-selected temperature is in the range of room temperature to 300° C.

6. A method as claimed in claim 1 wherein said calender rolls are set to a pre-selected gap width according to at least one material included in the substrate and a characteristic desired in the fabric.

7. A method as claimed in claim 6 wherein said at least one material is in a form selected from the group consisting of yarns, fibers, filaments, spiral coils, foils, films, and laminates.

8. A method as claimed in claim 1 wherein the substrate is an endless or modifeid endless woven fabric.

9. A method as claimed in claim 1 wherein the substrate is a flat woven fabric.

10. A method as claimed in claim 1 wherein at least one of said calender rolls comprises a composite material selected from the group consisting of ceramic and cermet alloy.

11. A method as claimed in claim 1 wherein said calender rolls form a nip and the substrate passes through said nip at a pre-selected speed, and said pre-selected speed is selected according to at least one material included in the substrate and a characteristic desired in the fabric.

12. A method as claimed in claim 11 wherein said at least one material is in a form selected from the group consisting of yarns, fibers, filaments, spiral coils, foils, films, and laminates.

13. A method as claimed in claim 1 wherein the industrial process fabric is a papermaker's fabric used in the forming portion of a papermaking process.

14. A method as claimed in claim 1 wherein the industrial process fabric is a papermaker's fabric used in the pressing portion of a papermaking process.

15. A method as claimed in claim 1 wherein the industrial process fabric is a papermaker's fabric used in the drying portion of a papermaking process.

16. A method as claimed in claim 1 wherein the industrial process fabric is a fabric selected from the group consisting of a through-air-drying (TAD) fabric, a double-nip-thickener (DNT) dewatering fabric, a chemiwasher process fabric/belt and a nonwoven production fabric.

17. A method as claimed in claim 1 wherein when said calender rolls apply a gap-based calendering to said substrate, the gap between said calender rolls being in the range of 0.1 mm to 4.0 mm.

18. A method as claimed in claim 1 wherein the width of at least one of said calender rolls is substantially equal to or greater than the full width of said substrate.

19. A method as claimed in claim 1 wherein the width of at least one of said calender rolls is less than the width of said substrate, such that the calender rolls must pass over the length of said substrate a plurality of times to traverse the entire substrate width.

20. A method as claimed in claim 19 wherein said calender rolls traverse said substrate in a spiral manner.

21. A method as claimed in claim 1 wherein said at least two calender rolls both have a width that is less than the width of said substrate, such that the calender rolls must pass over the length of said substrate a plurality of times to traverse the entire substrate width.

22. A method as claimed in claim 21 wherein said calender rolls traverse said substrate in a spiral manner.

23. A method as claimed in claim 1 wherein said substrate has a width that is less than a desired finished width, and after passing said substrate through said calender rolls said substrate is spirally assembled into a finished substrate having a desired length and a width that is at least substantially equal to said desired finished width.

24. A method as claimed in claim 1; wherein said substrate is full width of the fabric.

25. An industrial process or an engineered fabric formed by passing a substrate through at least two calender rolls such that the substrate is permanently deformed, wherein said calender rolls apply a gap-based calendering to said substrate with said calender rolls being set to a pre-selected gap width.

26. The fabric as claimed in claim 25 further comprising heating at least one of said calender rolls to a pre-selected temperature.

27. The fabric as claimed in claim 26 wherein the forming of said fabric further comprises selecting said pre-selected temperature according to at least one material included in the substrate and a characteristic desired in the industrial process fabric.

28. The fabric as claimed in claim 27 wherein said at least one material is in a form selected from the group consisting of yarns, fibers, filaments, spiral coils, foils, films, and laminates.

29. The fabric as claimed in claim 26 further comprising selecting a temperature in the range of room temperature to 3000° C. as said pre-selected temperature.

30. The fabric as claimed in claim 25 wherein the forming of said fabric further comprises setting said calender rolls to a pre-selected gap width according to at least one material included in the substrate and a characteristic desired in the industrial process fabric.

31. The fabric as claimed in claim 30 wherein said at least one material is in a form selected from the group consisting of yarns, fibers, filaments, spiral coils, foils, films, and laminates.

32. The fabric as claimed in claim 25 wherein the substrate is a flat woven fabric.

33. The fabric as claimed in claim 25 wherein the substrate is an endless or modified endless woven fabric.

34. The fabric as claimed in claim 25 wherein at least one of said calender rolls comprises a composite material selected from the group consisting of ceramic and cermet alloy.

35. The fabric as claimed in claim 25 wherein the forming of said fabric further comprises setting said calender rolls to form a nip and passing the substrate through said nip at a pre-selected speed, said pre-selected speed being selected according to at least one material included in the substrate and a characteristic desired in the industrial process fabric.

36. The fabric as claimed in claim 35 wherein said at least one material is in a form selected from the group consisting of yarns, fibers, filaments, spiral coils, foils, films, and laminates 37. The fabric as claimed in claim 25 wherein the fabric is a papermaker's fabric used in the forming portion of a papermaking process.

38. The fabric as claimed in claim 25 wherein the fabric is a papermaker's fabric used in the pressing portion of a papermaking process.

39. The fabric as claimed in claim 25 wherein the fabric is a papermaker's fabric used in the drying portion of a papermaking process.

40. The fabric as claimed in claim 25 wherein the fabric is a fabric selected from the group consisting of a through-air-drying (TAD) fabric, a double-nip-thickener (DNT) dewatering fabric, a chemiwasher process fabric/belt and a nonwoven production fabric.

41. The fabric as claimed in claim 25 wherein when said calender rolls apply a gap-based calendering to said substrate, the gap between said calender rolls being in the range of 0.1 mm to 4.0 mm.

42. The fabric as claimed in claim 25 wherein the width of at least one of said calender rolls is substantially equal to or greater than the full width of said substrate.

43. The fabric as claimed in claim 25 wherein the width of at least one of said calender rolls is less than the width of said substrate, such that the calender rolls must pass over the length of said substrate a plurality of times to traverse the entire substrate width.

44. The fabric as claimed in claim 43 wherein said calender rolls traverse said substrate in a spiral manner.

45. The fabric as claimed in claim 25 wherein said at least two calender rolls both have a width that is less than the width of said substrate, such that the calender rolls must pass over the length of said substrate a plurality of times to traverse the entire substrate width.

46. The fabric as claimed in claim 44 wherein said calender rolls traverse said substrate in a spiral manner.

47. The fabric as claimed in claim 25 wherein said substrate has a width that is less than a desired finished width, and after passing said substrate through said calender rolls said substrate is spirally assembled into a finished substrate having a desired length and a width that is at least substantially equal to said desired finished width.

48. A fabric as claimed in claim 25, wherein said substrate is full width of the fabric.

49. A fabric as claimed in claim 25, wherein said substrate is calendered by said calender rolls in sequential MD or CD bands until the entire fabric is calendered.

50. A fabric as claimed in claim 25, wherein said substrate is calendered by said calender rolls in just the edges of the substrate to reduce fabric permeability.

51. A fabric as claimed in claim 25, wherein a load applied by said calender rolls is between OkN/m and 500 kN/m.

52. A method for smoothing the surface of an industrial process or engineered fabric, said method comprising the steps of:

providing said fabric;

providing a pair of calender rolls, at least one of said pair of calender rolls being heated to a pre-selected temperature, said calender rolls forming a nip of pre-selected gap width, said calender rolls further having smooth surfaces;

placing said fabric under tension in a lengthwise direction; and directing said fabric in said lengthwise direction through said nip at a pre-selected speed, whereby said surface of said fabric is smoothed and its permeabilities to air and water set to desired levels.

53. A method as claimed in claim 52 wherein said fabric is endless or modified endless woven.

54. A method as claimed in claim 52 wherein said fabric is flat woven.

55. A method as claimed in claim 52 wherein said pre-selected temperature is in the range from room temperature to 3000° C.

56. A method as claimed in claim 52 wherein said pre-selected gap width is in the range from 0.1mm to 4.0 mm.

57. A method as claimed in claim 52 wherein said pre-selected speed is in the range from 0.5 m/min to 10.0 m/min.

58. A method as claimed in claim 52 wherein the industrial process fabric is a papermaker's fabric used in the forming portion of a papermaking process.

59. A method as claimed in claim 52 wherein the industrial process fabric is a papermaker's fabric used in the pressing portion of a papermaking process.

60. A method as claimed in claim 52 wherein the industrial process fabric is a papermaker's fabric used in the drying portion of a papermaking process.

61. A method as claimed in claim 52 wherein the industrial process fabric is a fabric selected from the group consisting of a through-air-drying (TAD) fabric, a double-nip-thickener (DNT) dewatering fabric, a chemiwasher process fabric/belt and a nonwoven production fabric.

62. A method as claimed in claim 52 wherein the width of at least one of said calender rolls is substantially equal to or greater than the full width of said fabric.

63. A method as claimed in claim 52 wherein the width of at least one of said calender rolls is less than the width of said fabric, such that the calender rolls must pass over the length of said fabric a plurality of times to traverse the entire fabric width.

64. A method as claimed in claim 63 wherein said calender rolls traverse said fabric in a spiral manner.

65. A method as claimed in claim 52 wherein said at least two calender rolls both have a width that is less than the width of said fabric, such that the calender rolls must pass over the length of said fabric a plurality of times to traverse the entire fabric width.

66. A method as claimed in claim 65 wherein said calender rolls traverse said fabric in a spiral manner.

67. A method as claimed in claim 52, wherein said fabric has a width that is less than a desired finished width, and after passing said fabric through said calender rolls said fabric is spirally assembled into a finished fabric having a desired length and a width that is at least substantially equal to said desired finished width.

68. A method for processing an industrial process or engineered fabric, comprising the step of:

passing a substrate through at least two calender rolls such that the substrate is permanently deformed, wherein said calender rolls apply a gap-based or load-based calendering to said substrate, with said calender rolls being set to a pre-selected gap width if calendering the full-width of the substrate, and said calender rolls being set to a pre-selected gap width or a pre-selected load if the calendering is less than full-width of the substrate.

69. A method for processing an industrial process or engineered fabric, comprising the step of:

passing a substrate through at least two calender rolls such that the substrate is permanently deformed, wherein said calender rolls apply a gap-based or load-based calendering to said substrate, with said calender rolls being set to a pre-selected gap width or a pre-selected load, wherein said substrate has a width that is less than a desired finished width, and spirally assembling said substrate into a finished fabric having a desired length and a width that is at least substantially equal to said desired finished width.

70. A method as claimed in claim 1 or 52, wherein said calender rolls calender said substrate or fabric in sequential MD or CD bands until the entire fabric is calendered.

71. A method as claimed in claim 1 or 52, wherein said calender rolls calender just edges of the substrate or fabric to reduce fabric permeability.

72. A method as claimed in claim 1, 52, 68 or 69 wherein the load applied by said calender rolls is between OkN/m and 500 kN/m.

73. The method as claimed in claim 68 or 69, wherein said substrate is calendered by said calender rolls in just the edges of the substrate to reduce fabric permeability.

74. The method as claimed in claim 73, wherein said calendar rolls are set to a pre-selected load.

* * * * *